US006565187B2

(12) United States Patent
Karita et al.

(10) Patent No.: US 6,565,187 B2
(45) Date of Patent: May 20, 2003

(54) LIQUID EJECTING HEAD AND LIQUID EJECTING APPARATUS

(75) Inventors: Seiichiro Karita, Kanagawa (JP); Manabu Sueoka, Kanagawa (JP); Toru Yamane, Kanagawa (JP); Junji Yasuda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/986,802

(22) Filed: Nov. 13, 2001

(65) Prior Publication Data

US 2002/0060715 A1 May 23, 2002

(30) Foreign Application Priority Data

Nov. 17, 2000 (JP) ..... 2000-350425

(51) Int. Cl.[7] ..... B41J 2/165; B41J 2/155

(52) U.S. Cl. ..... 347/29; 347/42

(58) Field of Search ..... 347/29, 44, 58, 347/42

(56) References Cited

U.S. PATENT DOCUMENTS 5,117,244 A * 5/1992 Yu ..... 347/29
5,347,713 A 9/1994 Shibata et al. ..... 29/890

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

The present invention provides a liquid ejecting head and a liquid ejecting apparatus which permits downsizing of the liquid ejecting head and cost reduction, and furthermore, provides a liquid ejecting head and a liquid ejecting apparatus which permits size reduction of the liquid ejecting head, improvement of reliability of the electrical mounting section, and cost reduction.

6 Claims, 12 Drawing Sheets

LIQUID EJECTING HEAD AND LIQUID EJECTING APPARATUS

BACKGROUND OF THE INVENTION

1. Field of the Invention

The present invention relates to a liquid ejecting head discharging a liquid from discharge port and a liquid ejecting apparatus mounting the liquid ejecting head.

2. Description of the Related Art

A liquid ejecting (ink jet) apparatus is of the so-called non-impact recording type, and has features of permitting recording of information at a high speed and on various recording media, and of being almost free from noise upon recording. On account of these features, the liquid ejecting apparatus is widely adopted as a recording apparatus in printers, wordprocessors, facsimile machines, copying machines and the like.

The liquid ejecting apparatus is based on steps of discharging fine liquid drops from small discharge ports arranged on a liquid ejecting head and depositing these drops onto a recording medium, thereby accomplishing recording. Discharge energy generating elements using a piezo-element or an electro-thermal conversion element are known. Such a liquid ejecting apparatus generally comprises a liquid ejecting head having a nozzle for forming liquid drops, and a liquid feed system feeding the liquid to the liquid ejecting head. For example, in a liquid ejecting head using an electro-thermal conversion element, heat energy is imparted to a liquid by providing the electro-thermal conversion element in a nozzle and applying electric pulses giving a discharge signal thereto, and a foaming pressure occurring upon foaming (boiling) of the liquid caused by a phase change of the liquid is used for discharging liquid drops.

Liquid ejecting heads using electro-thermal conversion as described above are classified into a type in which the liquid is discharged in parallel with an element board having electro-thermal conversion elements arranged thereon (edge shooter), and a type in which the liquid is discharged perpendicularly to the element board having electro-thermal conversion elements arranged thereon (side shooter). A concrete configuration of the liquid ejecting head will now be described by citing the side shooter as an example with reference to FIGS. 15 and 16.

FIG. 15 is a schematic perspective view of a liquid ejecting head of a conventional side shooter; and FIG. 16 is a sectional view of the same liquid ejecting head cut along a direction (line Y—Y) perpendicular to the discharge port arranging direction.

In FIGS. 15 and 16, a plurality of discharge ports 202 for discharging a liquid are pierced on the surface side near the center of an element board 201, and electro-thermal conversion elements (called also heating elements or heaters, and hereinafter simply referred to as heating elements) 203 corresponding to the individual discharge ports 202, for heating the liquid are formed on the element board 201.

Electric wiring of the heating elements 203 is connected to a transistor circuit for driving the heating elements 203. The transistor circuit is built in the element board, or mounted by mounting a separate element having a built-in transistor circuit. In an element board having a relatively small number of heating elements, it is the usual practice to build a transistor circuit in the element board. In an element board having a relatively large number of heating elements for the purpose of increasing the printing width, the configuration having the transistor circuit built in the element board leads to a considerable decrease in yield of the element board. The method of mounting the separate element having the transistor circuit built therein onto the element board is more advantageous in yield. FIGS. 15 and 16 illustrate a conventional case where separate driving elements (drivers IC) 205 having built-in transistor circuit for driving the heating elements 203 are mounted on the element board 201.

The driving element 205 having the transistor circuit for driving the heating element 203 is mounted on the element board 201 by the COB (chip on board) connecting method using an anisotropic conductive film or a soldered bump, and electrically connected to the electric wiring from the heating element 203. A logic circuit for driving the transistor is mounted on the driving element 205, in addition to the transistor circuit. The logic circuit is connected to a flexible film (flexible circuit board) 206 via the element board 201, and a signal for driving the logic circuit is provided via the flexible film 206. The flexible film 206 is connected by the COB connecting method based on an anisotropic conductive film or the like to a circuit board 207 comprising a composite material of the element board 201 and a glass epoxy or the like. The circuit board 207 is fixed to a side of a supporting member 212 and electrically connected to an area outside of the head. The flexible film 206 is bent along the side surface of the supporting member 212 from an end of the element board 201.

The electric connecting portions of the driving element 205 and the flexible film 206 are covered and sealed by a sealing agent 214 (FIG. 16) excellent in sealing and ion shielding abilities such as an epoxy resin, a fluororesin, or a silicone resin to avoid corrosion of electrodes or substrate metals caused by deposition on the electrodes of liquid drops scattering from the discharge port or liquid rebounding from the recording medium.

As shown in FIG. 16, a slit 204 for receiving the liquid fed from the back is formed by anisotropic etching or the like on the element board 201. Common liquid chamber 210 communicating with a slit 204 formed in the element board 201 are formed on a holding member 211 and the supporting member 212 of the element board. A liquid feed port 213 for feeding the liquid to the common liquid chamber 210 is formed in the supporting member 212. The liquid feed port 213 communicates with a liquid feed tank not shown. A liquid feed channel is formed by laminating the element board 201, the holding member 211 and the supporting member 212 as shown in FIG. 16.

In the liquid ejecting apparatus, when mixture of bubbles or dust in the fine discharge port (nozzle) 202 of the liquid ejecting head occurs, or when evaporation of volatile matter in the liquid prevents discharge of the liquid, a discharge recovery operation is conducted, in which factors causing defective discharge are eliminated by refreshing the liquid. Available methods for such a discharge recovery operation include a method of providing a cap capable of covering the discharge port of the liquid ejecting head and a pump communicating with this cap and applying a suction force, and forcibly sucking out the liquid from the discharge port under the action of the suction force in a state in which the liquid ejecting head and the cap are kept in close contact; and a method of providing a mechanism applying a pressure on the liquid from the liquid feeding side of the liquid ejecting head, and forcibly extruding the liquid from the discharge port of the liquid ejecting head by applying the pressure from the liquid feeding side. In any of these methods, it is necessary to keep the liquid ejecting head and the cap in a perfectly enclosed state not permitting in-flow or out-flow of the liquid or air.

When the liquid ejecting head is in a standby state in which the liquid is not discharged, it is necessary to maintain the liquid ejecting head and the cap in close contact to prevent an increase in viscosity caused by evaporation of a liquid solvent or by solidification.

For this purpose, in the liquid ejecting head, it is necessary to provide an area suitable for obtaining and maintaining close contact with the cap. In a conventional liquid ejecting head, a flat surface for receiving the cap 217 (see FIG. 16) is provided between the row of discharge ports on the element board 201 and the driving element 205.

SUMMARY OF THE INVENTION

However, in the conventional liquid ejecting head as described above, in which the flat area for receiving the cap 217 is provided on the element board 201, the necessity to increase the area of the element board 201 leads to the need to increase the size of the liquid ejecting head. Usually, when preparing an element board, a plurality of element boards are cut from a substrate. Increase in size of an element board corresponds to a decrease in the number of board available from a substrate, thus resulting in a large increase in the unit cost per head.

In the conventional liquid ejecting head with a printing width of up to 25.4 mm (1 inch), it is possible to build in functions of the driving element 205 in the element board 201. With a printing width having a length in the discharge port arrangement direction of over 25.4 mm (1 inch), there occurs an extreme decrease in the yield of integrated circuits. It is therefore inevitable to adopt the method of separately preparing driving elements 205 and mounting them on the element board 201 as described above.

Thus, because of the necessity to provide a flat area for receiving the cap 217 and an area for mounting the driving elements 205, the element board 201 must be larger in size, resulting in a wider width of the liquid ejecting head. When arranging a plurality of element boards widening the width of the liquid ejecting head also in the discharge port arrangement direction, there is an increase in the area where an appropriate gap is to be provided between the head and the recording medium to maintain a high print quality, so that it is easy to keep a certain gap over the entire area. Parallel arrangement of a plurality of liquid ejecting heads led to an increase in the size of the main body of the liquid ejecting apparatus, and hence to a cost increase.

Therefore, the present invention was developed in view of the aforementioned problems of the conventional art not as yet solved, and has as an object to provide a liquid ejecting head and a liquid ejecting apparatus which permits downsizing of the liquid ejecting head and cost reduction, and furthermore, to provide a liquid ejecting head and a liquid ejecting apparatus which permits size reduction of the liquid ejecting head, improvement of reliability of the electrical mounting section, and cost reduction.

To achieve the above-mentioned object, the liquid ejecting head of the present invention comprises a discharge port forming member having a plurality of discharge ports for discharging a liquid arranged therein; an element board having a plurality of discharge energy generating elements for imparting discharge energy to the liquid provided to face the plurality of discharge ports, respectively, and a liquid feed port communicating with the plurality of discharge ports; a holding member forming a common liquid chamber for feeding the liquid to the plurality of discharge ports via the liquid feed port of the element board and holding and fixing the element board; and a plurality of driving elements for driving the plurality of discharge energy generating elements; wherein the plurality of driving elements are mounted in a mounting area which is a region outside the discharge port forming member; and wherein the liquid ejecting head has a cap receiving member for capping the liquid discharge head in the mounting area, and the cap receiving member has a shape enclosing the discharge port forming member.

In the liquid ejecting head of the invention, the cap receiving member or a portion thereof should preferably be arranged on the plurality of driving elements. In this case, it is desirable that a complementary member or a sealing agent having substantially the same thickness as that of the driving element is arranged in an area where the driving elements are not mounted within the mounting area. Or, it is desirable that a portion of the cap receiving member arranged in the area not having the driving elements mounted thereon has a thickness larger than the portion having the driving elements mounted thereon, by the thickness of the driving element.

In the liquid ejecting head of the invention, a flexible circuit board for electrically connecting the plurality of driving elements to an area outside of the head is connected to the mounting area of the element board, and the cap receiving member is arranged also on the connecting portion of the flexible circuit board to the element board. In this case, a complementary member or a sealing agent having substantially the same thickness as that of the flexible circuit board is arranged in an area where the flexible circuit board is not arranged within the mounting area. Or, the portion of the cap receiving member arranged in the area not having the flexible circuit board arranged therein has a thickness larger than the portion having the flexible circuit board arranged therein by the thickness of the flexible circuit board. In the liquid ejecting head of the invention, the cap receiving member should preferably comprise a film material.

The liquid ejecting head of the invention comprises a discharge port forming member having a plurality of discharge ports for discharging a liquid arranged therein; an element board having a plurality of discharge energy generating elements for imparting discharge energy to the liquid provided to face the plurality of discharge ports, respectively, and a liquid feed groove communicating with the plurality of discharge ports; a holding member forming a common liquid chamber for feeding the liquid to the discharge ports via the liquid feed port of the element board and holding the element board; a plurality of driving elements for driving the plurality of discharge energy generating elements; and a flexible circuit board for electrically connecting the plurality of driving elements to an area outside of the head; wherein the driving elements are mounted on the element board, and the flexible circuit board is connected to the element board and bent substantially at a right angle at an end of the element board; and wherein the liquid ejecting head has a cap receiving member for receiving a cap for capping the liquid ejecting head around the element board; and the cap receiving member has a shape enclosing the discharge port forming member.

In the liquid ejecting head of the invention, the flexible circuit board should preferably be bent and inserted into a gap between the cap receiving member and the element board. In this case, it is desirable that at least a portion of the flexible circuit board corresponding to a side of the element board is covered with a protecting member fixed to the holding member, and at least a part of the cap receiving member is arranged on the protecting member. It is also desirable that a sealing agent is charged into a gap between the cap receiving member and the element board. The portion of the flexible circuit board arranged on the element board should preferably be covered with a sealing agent. The liquid ejecting head of the invention comprises a plurality of discharge port forming members having a plurality of discharge ports for discharging a liquid arranged therein; a plurality of element boards having a plurality of discharge energy generating elements for imparting discharge energy to the liquid provided to face the plurality of discharge ports, respectively, and a liquid feed port communicating with the plurality of discharge ports; a holding member forming a common liquid chamber for feeding the liquid to the plurality of discharge ports via the liquid feed ports of the plurality of element boards and holding and fixing the element boards; and a plurality of driving elements for driving the plurality of discharge energy generating elements; wherein the plurality of driving elements are mounted in a mounting area which is a region outside the discharge port forming members; and wherein the liquid ejecting head has a cap receiving member receiving a cap for capping the liquid discharge head in the mounting area, and the cap receiving member has a shape enclosing the discharge port forming member.

The invention provides also a liquid ejecting head comprising a plurality of discharge port forming members having a plurality of discharge ports for discharging a liquid arranged therein; a plurality of element boards having a plurality of discharge energy generating elements for imparting discharge energy to the liquid provided to face the plurality of discharge ports, and liquid feed ports communicating with the plurality of discharge ports; a holding member forming a common liquid chamber for feeding the liquid to the discharge ports via the liquid feed ports of the plurality of element boards and holding and fixing the element boards; a plurality of driving elements for driving the plurality of discharge energy generating elements; and a plurality of flexible circuit boards for electrically connecting the plurality of driving elements to an area outside of the head; wherein the plurality of driving elements are mounted on the element boards, and the flexible circuit board is connected to the plurality of element boards and bent substantially at a right angle at an end of each of said element boards; and wherein the liquid ejecting head has a cap receiving member for receiving a cap for capping the liquid ejecting head around the element board; and the cap receiving member has a shape enclosing in a lump the plurality of discharge port forming members.

In the liquid ejecting head of the invention, the discharge energy generating element may be a heating element which converts electric energy into heat energy and discharges the liquid accompanied by a foaming phenomenon of the liquid.

The liquid ejecting apparatus of the invention mounts the aforementioned liquid ejecting head and has a cap for capping the liquid ejecting head, wherein, when the liquid ejecting head is in standby state, capping is applied to the cap receiving member.

According to the present invention, in the liquid ejecting head, it is possible to reduce the area of the element board, to accomplish proper capping, and to avoid non-discharge at the start of liquid discharge without necessity of a special area for receiving the cap on the element board as in the conventional art. This is achieved by setting the portion for the cap in an area surrounding the row of discharge ports by use of the upper surface of the driving element mounted on the board element or the upper surface of the flexible film (flexible circuit board) connected to the element board, or on members arranged around the element board, so as to prevent evaporation of volatile constituents of the liquid. The ability to reduce the area of the element board permits cost reduction of the liquid ejecting head.

By adopting a configuration in which the flexible film extending from the mounting section on the element board is bent in the interior of the cap receiving member, or a configuration in which the flexible film is positioned on the lower surface of the cap receiving member, it is possible to protect the flexible film from the liquid by means of the cap receiving member, and to improve reliability by preventing exposure of the electric connecting sections to the liquid. Since the flexible film is not exposed to the conveying section of the recording medium, it is possible also to provide a liquid ejecting head free from damage to the flexible film caused by defective conveyance of the recording medium and therefore having a still higher reliability.

The liquid ejecting head itself can be downsized. When arranging the plurality of elements in parallel, it is possible to considerably reduce the area within which the interval between the head and the recording medium is controlled. This makes it possible to improve the print quality, reduce the size of the apparatus using a plurality of liquid ejecting heads, and to reduce the cost.

Further objects, features and advantages of the present invention will become apparent from the following description of the preferred embodiments with reference to the attached drawings.

DESCRIPTION OF THE PREFERRED EMBODIMENTS

Embodiments of the present invention will now be described with reference to the drawings.

First Embodiment

Figure 2A:
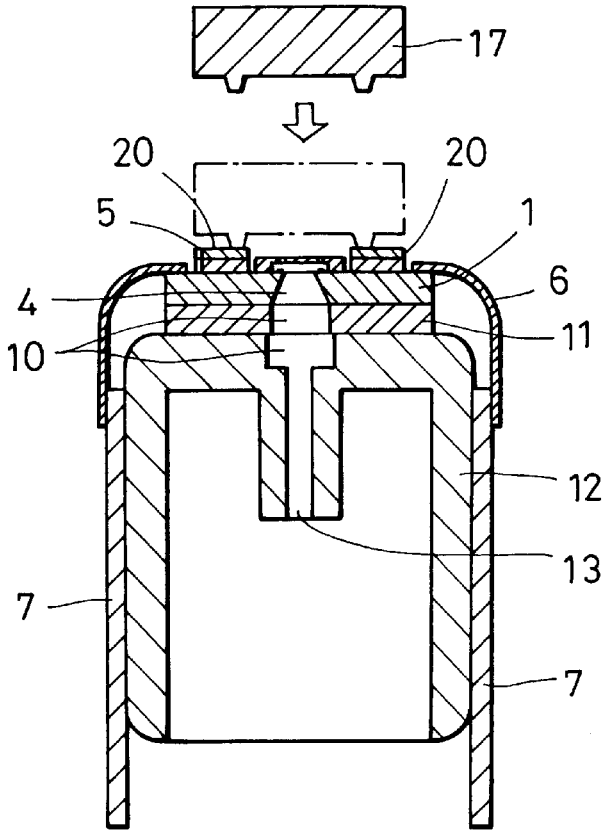
FIG. 2A gives a sectional view of the first embodiment of the liquid ejecting head, cut in a direction (Y—Y line) perpendicular to the discharge port arrangement direction and a view illustrating the positional relationship with the cap.
Figure 2B:
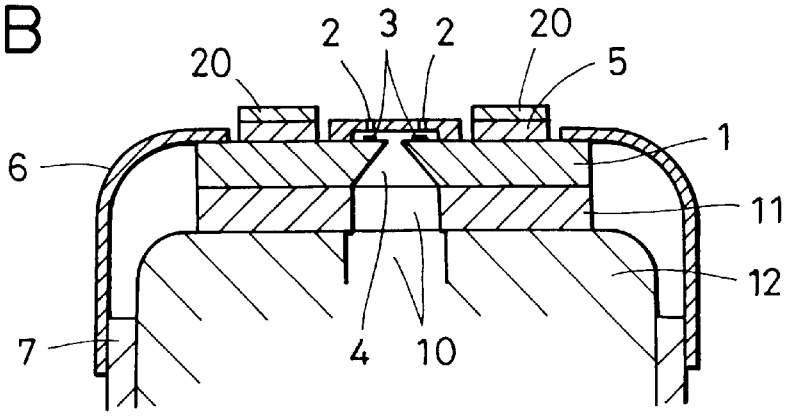
FIG. 2B is a partially enlarged view of the liquid discharge surface in this embodiment.
Figure 3:
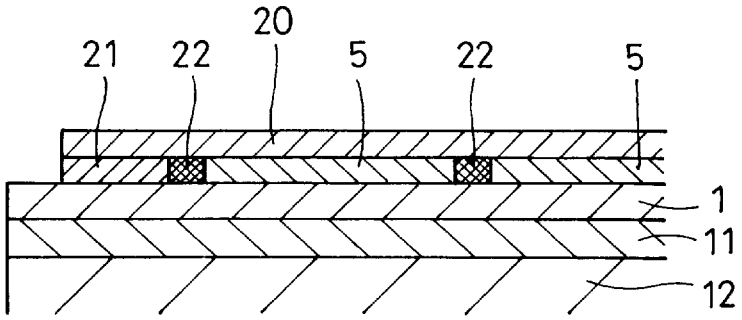
FIG. 3 is a schematic partial sectional view of FIG. 1 cut along the line A—A.

A first embodiment of the liquid ejecting head of the invention will be described with reference to FIGS. 1 to 3.

Figure 1:
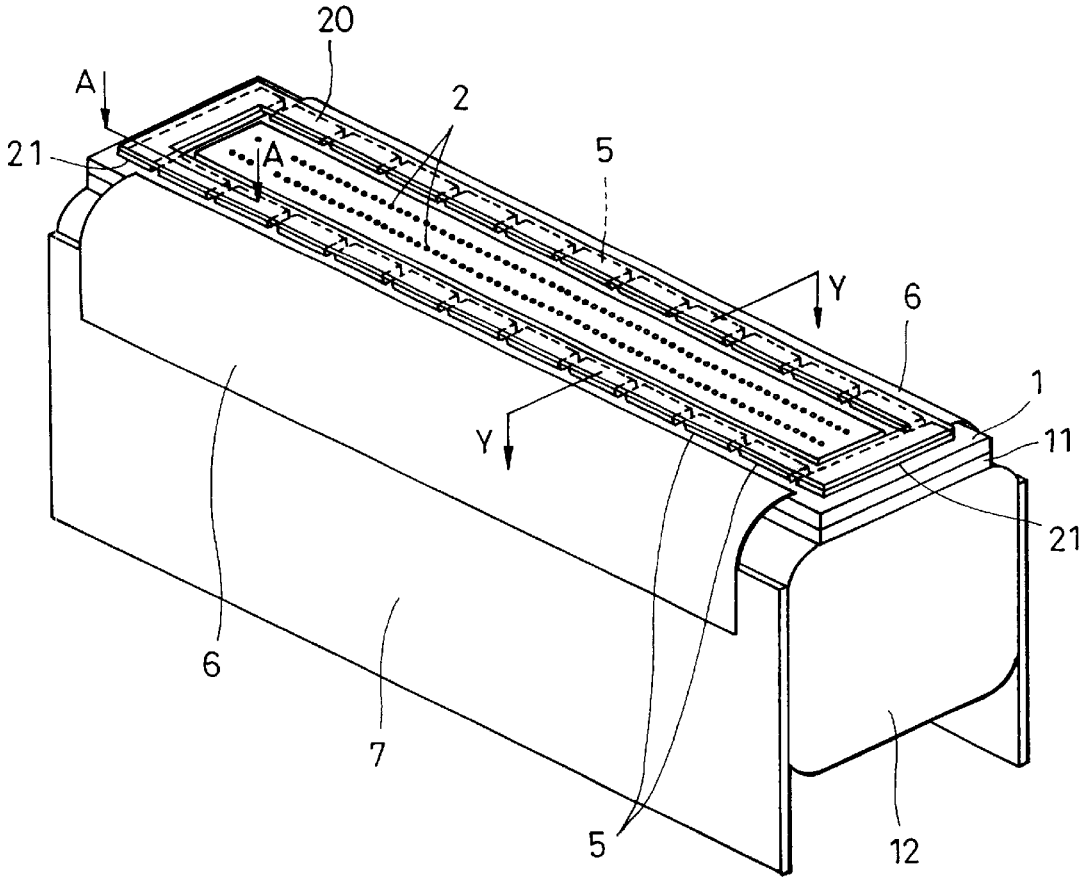
FIG. 1 is a perspective view illustrating a first embodiment of the liquid ejecting head of the present invention.

FIG. 1 is a perspective view illustrating the first embodiment of the liquid ejecting head of the invention; FIG. 2A is a sectional view of the liquid ejecting head of this embodiment cut in a direction perpendicular to the discharge port arrangement direction (line Y—Y); FIG. 2B is a partial enlarged sectional view of the liquid discharge surface; and FIG. 3 is a schematic partial sectional view of FIG. 1 cut along the line A—A.

In the liquid ejecting head of the invention, two rows of a plurality of discharge ports 2 for discharging a liquid are provided in parallel on the surface side near the center of an element board 1. Heating elements (electro-thermal conversion elements) 3 (see FIG. 2B) serving as discharge energy generating elements corresponding to the respective discharge ports 2 are formed on the element board 1. The heating elements 3 cause foaming of the liquid through electric heating, and discharge the liquid from the discharge ports 2 under the effect of the kinetic energy (discharge energy) thereof.

A pair of wiring lines (not shown) for feeding electric power from outside the head are connected to each of the heating elements 3, and each of these wiring lines is electrically connected to a driving element (driver IC) 5 on which a transistor circuit for driving the heating element 3 is mounted. The driving element 5 is mounted on the element board 1 by the COB (chip on board) connecting method via an anisotropic conductive film. A logic circuit for driving the transistors is mounted on the driving element 5, in addition to the transistor circuit. The logic circuit is connected to a flexible film (flexible circuit board) 6 via the element board 1, and a signal for driving the logic circuit is given via the flexible film 6. The flexible film 6 is connected to the element board 1 and a circuit board (printed board) 7 comprising a composite material such as glass epoxy. The flexible film 6 is bent substantially at a right angle from an end of the element board 1 along a supporting member 12, and the circuit board 7 is fixed to a side of the supporting member 12. An electric connector (not shown) for inputting electric signals and the like from outside the head is mounted on the circuit board 7, and a liquid discharge signal is input from outside the head.

Although not shown, the electric connecting sections of the driving elements 5 and the flexible films 6 are covered and sealed with a resin sealing agent such as epoxy, silicone or fluororesin excellent in sealing property and ion shielding abilities so as to prevent a decrease in electrical connection reliability caused by the liquid. That is, the sealing agent prevents corrosion of the electrodes or the substrate metals caused by liquid drops scattering from the discharge ports or rebounding from the recording medium, which could be deposited onto the electrodes if the electrode section were exposed.

A common liquid chamber 10 for holding the liquid formed by a holding member 11 and a supporting member 12 of the element board 1 having a length substantially equal to the length of the row of discharge ports are provided on the back side of the element board 1. A slit 4 for feeding the liquid in the common liquid chamber 10 is also provided on the back side on the element board 1. The common liquid chamber 10 has a configuration in which the liquid is supplied from a liquid feed tank (not shown) via a liquid feed port 13.

In this embodiment, the upper surfaces of the plurality of driving elements 5 arranged and mounted on the element board 1 are used for receiving a cap 17 (FIG. 2A) for preventing evaporation of volatile constituents of the liquid in the standby state of the liquid ejecting head. With a view to providing a flat surface for ensuring a satisfactory hermeticity upon capping, a filmy cap receiving member 20 having a shape enclosing all the discharge ports 2 is provided on the upper surface of the driving elements 5.

If the filmy cap receiving member 20 is simply provided on the upper surface of the driving elements 5, a satisfactory hermeticity is unavailable upon capping because of the presence of large steps between any two neighboring driving elements where no driving element is present, i.e., at both ends of the element board 1 in the discharge port arrangement direction. In this embodiment, therefore, as shown in FIGS. 1 and 3, a complementary member 21 having substantially the same thickness as the driving elements 5 is arranged in the portions not having driving elements, i.e., at both ends of the element board 1, so as to eliminate the step, and a flat surface is worked out by attaching the filmy cap receiving member 20 on the upper surface of the driving elements 5 and of the complementary member 21. Furthermore, hermeticity is improved by injecting a sealing agent 22 such as a silicone sealant into the gaps between each two adjacent driving elements 5 and the gaps between the driving element 5 and the complementary member 21.

The material for the filmy cap receiving member 20 should preferably be a substance having a high resistance to liquid such as resin materials including polyimide, silicone rubber, and polytetrafluoroethylene (Teflon) and an SUS metal sheet. For bonding the filmy cap receiving member 20, an epoxy adhesive may be used. Because the filmy cap receiving member 20 and surroundings tend to suffer from liquid deposition, the adhesive should comprise a material resistant to the liquid. There is no restriction imposed on the thickness of the filmy cap receiving member 20. However, the liquid ejecting head is usually used with a gap of up to about 2 mm between the head and the recording medium. The thicknesses of the driving elements 5 and the filmy cap receiving member 20 should be determined so as not to cause interference with the recording medium during liquid discharge (during printing). The material for the complementary member 21 should also preferably be highly resistant to liquid. Applicable materials include various resin materials and metals, or the same Si chip as the driving element 5.

It is needless to mention that the cap 17 has a structure in which, as shown by a one-point chain line in FIG. 2A, it can be put in perfectly close contact with the filmy cap receiving member 20 on the upper surface of the driving elements 5.

In the configuration as described above, by receiving the cap 17 in an area surrounding the discharge ports 2 on the upper surface of the driving elements 5, the necessity for a special area for receiving the cap on the element board as in the conventional art is eliminated, and it is accordingly possible to reduce the surface area of the element board. Furthermore, as shown in FIG. 2A, the cap 17 is received by the filmy cap receiving member 20 attached to the upper surfaces of the driving elements 5 arranged on the element board 1, thus ensuring secure capping, and non-discharge problems are never encountered at the start of liquid discharge. The ability to reduce the area of the element board permits cost reduction of the liquid ejecting head.

Second Embodiment

A second embodiment of the liquid ejecting head of the invention will now be described with reference to FIGS. 4 and 5.

Figure 4:
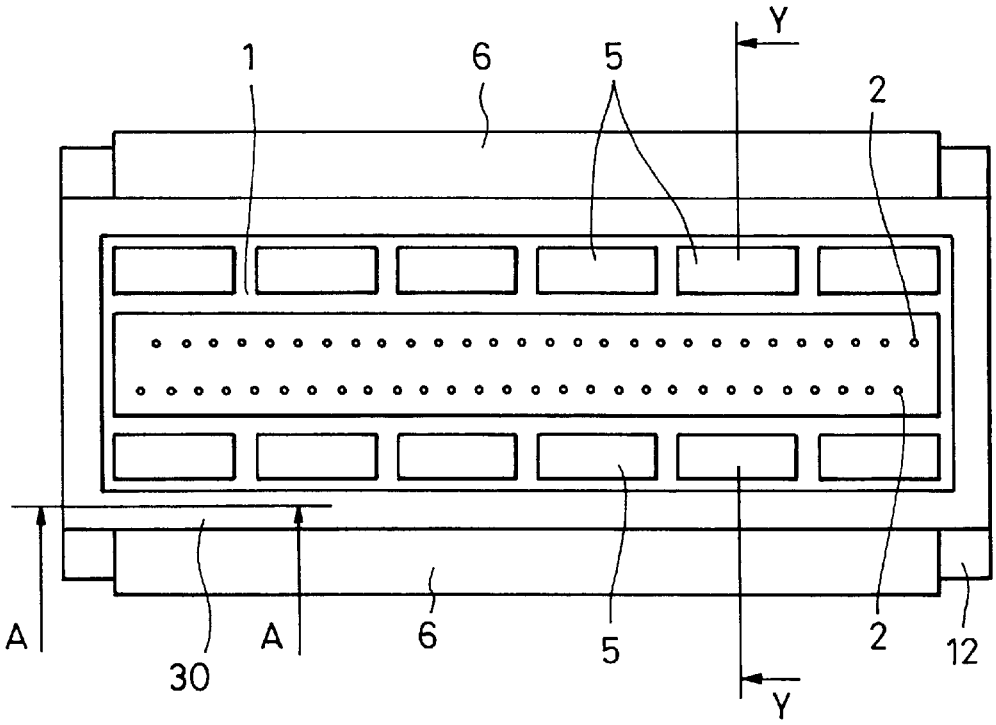
FIG. 4 is a plan view of the liquid discharge surface of a second embodiment of the liquid ejecting head of the invention.

FIG. 4 is a plan view of the liquid discharge surface in the second embodiment of the liquid ejecting head of the invention; FIG. 5 gives a sectional view of the liquid ejecting head of this embodiment cut in a direction perpendicular to the discharge port arrangement direction (line Y—Y) and a view illustrating the positional relationship with the cap; and FIG. 6 is a schematic partial sectional view of FIG. 4 cut along the line A—A.

In this embodiment, the cap is received on the upper surface of the flexible film connected to the end of the element board to prevent evaporation of volatile constituents of the liquid in the standby state of the liquid ejecting head. The present embodiment differs from the first embodiment in this point. Other particulars of the configuration are the same as in the above-mentioned first embodiment, and the same reference numerals are assigned to corresponding members and components, detailed description being omitted here.

Figure 5:
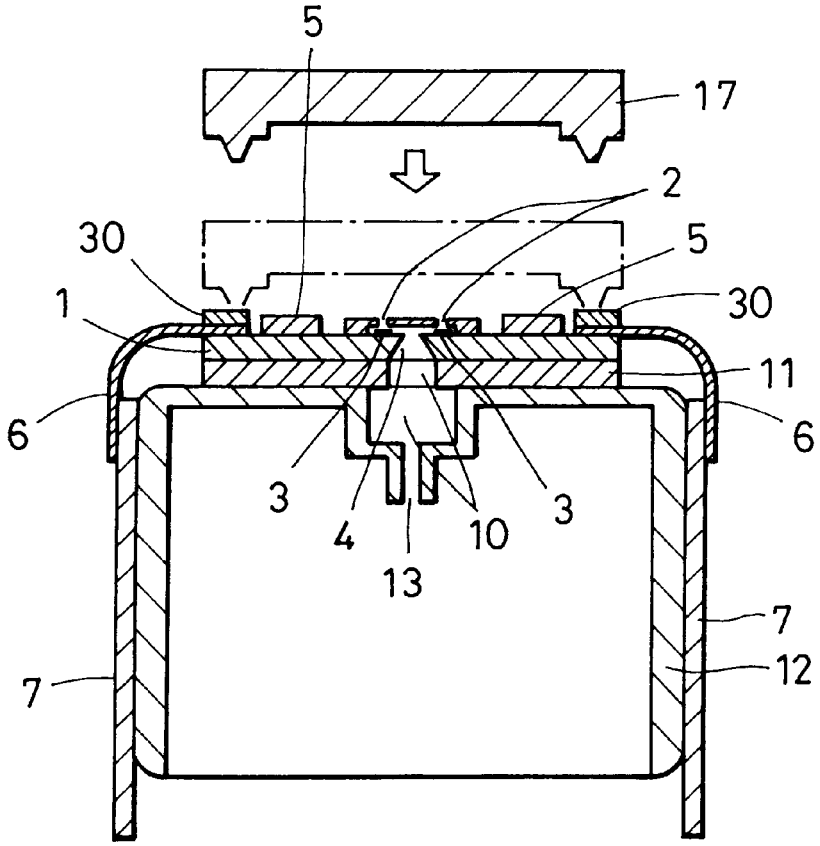
FIG. 5 gives a sectional view of the second embodiment of the liquid ejecting head of the invention cut in a direction (line Y—Y) perpendicular to the discharge port arrangement direction and a view illustrating the positional relationship with the cap.
Figure 6:
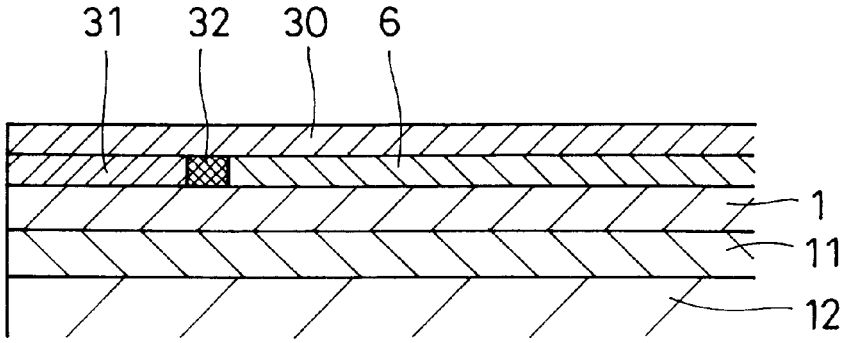
FIG. 6 is a schematic partial sectional view of FIG. 4 cut along the line A—A.

In the liquid ejecting head of this embodiment, as shown in FIGS. 4 and 5, the cap 17 is received on the upper surface of the flexible films 6 connected to both sides of the element board 1 to prevent evaporation of the liquid in the standby state of the liquid ejecting head. A filmy cap receiving member 30 having a shape enclosing all the discharge ports 2 on the upper surface of the flexible films 6 is provided so as to achieve a flat surface for obtaining an assured hermeticity upon capping. Because the flexible films are not arranged at either end of the liquid ejecting head in the discharge port arrangement direction, a step is produced at both ends. In addition, when a plurality of flexible films 6 are arranged on each side of element board 1, a step is produced between each two adjacent flexible films. As shown in FIGS. 4 and 6, for the purpose of eliminating the steps at both ends of the element board 1 where no flexible film 6 is arranged, and between each two adjacent flexible films 6, as in the aforementioned embodiment, a complementary member 31 having the same thickness as that of the flexible film 6 is arranged at each of the ends of the element board 1 and a sealing agent 32 is injected into the connecting portions between each two adjacent flexible films 6. It is thus possible to improve the flatness of the upper surface of the filmy cap receiving member 30 and the hermeticity of the capping.

The material for the filmy cap receiving member 30 for creating a flat surface should preferably have a high resistance to liquid, as was the case for the cap receiving member 20 in the above-mentioned first embodiment. Applicable materials include polyimide, silicone rubber, polytetrafluoroethylene (Teflon) and other resin materials and an SUS metal sheet.

The cap 17 should have a structure capable of coming into perfectly close contact with the filmy cap receiving member 30 on the upper surface of the flexible film 6, as shown by the one-point chain line in FIG. 5.

By adopting the configuration in which the cap 17 is received in an area enclosing the discharge ports 2 on the upper surface of the flexible films 6, the necessity of a special area for receiving the cap 17 on the element board 1 as in the conventional art is eliminated, and the surface area of the element board 1 can be reduced. It is possible to ensure tight capping, and non-discharge never occurs at the start of discharge. Since the area of the element board can be reduced, it is possible to reduce the cost of the liquid ejecting head.

Third Embodiment

A third embodiment of the liquid ejecting head of the invention will now be described with reference to FIGS. 7 and 8.

Figure 7:
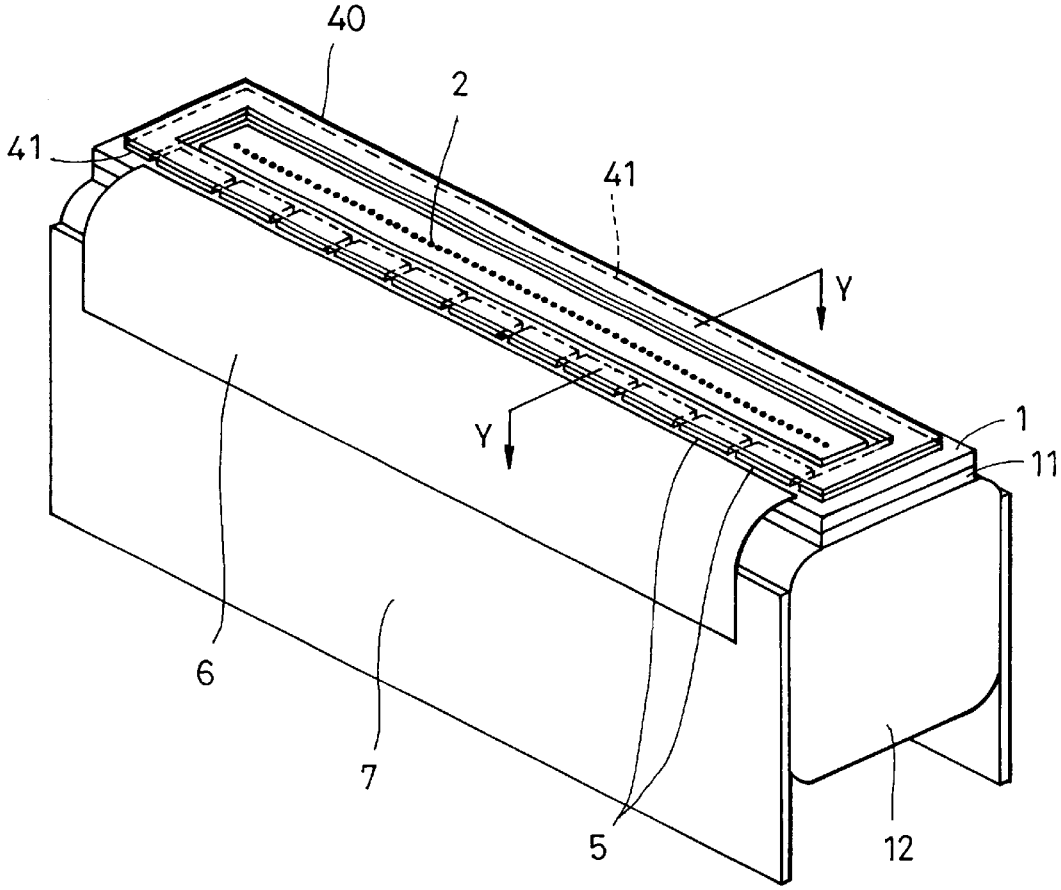
FIG. 7 is a perspective view illustrating a third embodiment of the liquid ejecting head of the invention.
Figure 8:
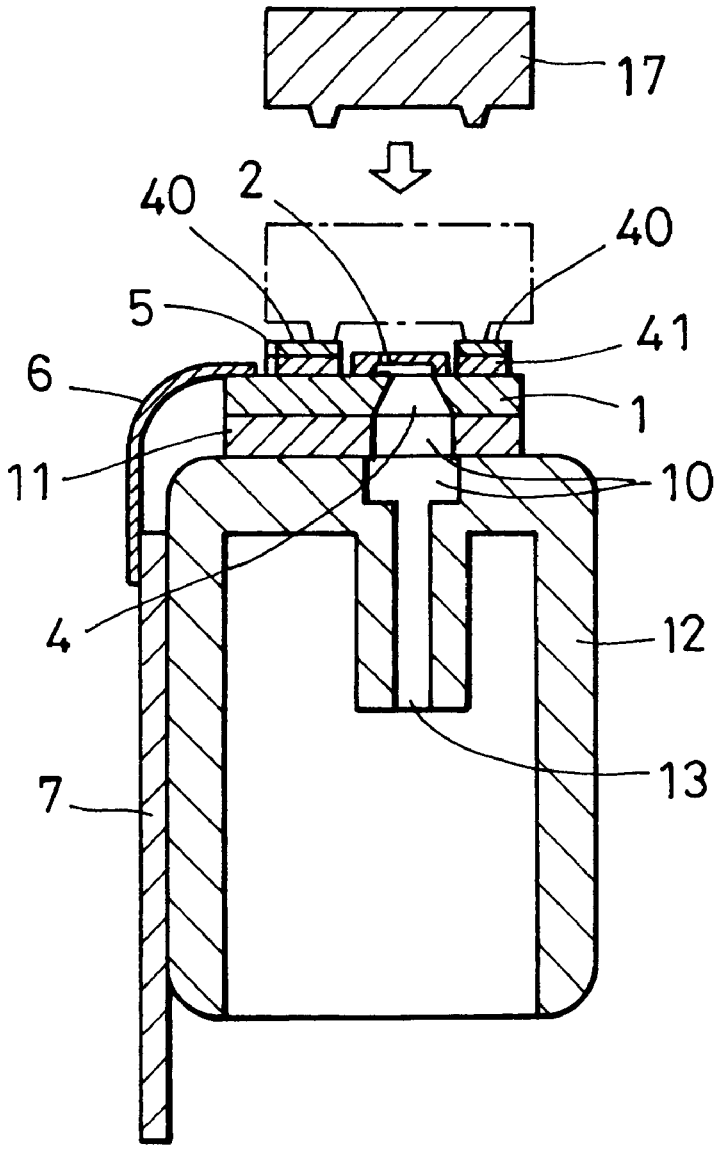
FIG. 8 gives a sectional view illustrating the third embodiment of the liquid ejecting head of the invention cut in a direction perpendicular to the discharge port arrangement direction (Y—Y line) and a view illustrating the positional relationship with the cap.

FIG. 7 is a perspective view illustrating the third embodiment of the liquid ejecting head of the invention; and FIG. 8 gives a sectional view of the liquid ejecting head of this embodiment and a view illustrating the positional relationship with the cap.

This embodiment, being different from the abovementioned first and second embodiments in the arrangement of discharge ports and heating elements, is the same for the other components as the above-mentioned first embodiment. The same reference numerals are assigned to the corresponding members and components, omitting detailed description.

In the liquid ejecting head of this embodiment, as shown in FIGS. 7 and 8, a plurality of discharge ports 2 and heating elements 3 are arranged each in one row on the element board 1. Driving elements 5, corresponding to the discharge ports 2 and the heating elements 3, are mounted only on one side of the element board 1. No driving elements are mounted on the other side.

In this embodiment, therefore, a complementary member 41 having substantially the same thickness as the driving elements 5 is arranged on the other side of element board 1 not having driving elements mounted thereon. More particularly, as shown in FIG. 7, the U-shaped complementary member 41 as viewed horizontally is arranged on the element board 1, and a filmy cap receiving member 40 is attached and bonded onto the driving elements 5 and the complementary member 41. As in the abovementioned first embodiment, a sealing agent (22) such as a silicone sealant is injected into the gap between each two adjacent driving elements 5 and the gap between the driving elements 5 and the complementary member 41, thus improving hermeticity. Applicable materials for the filmy cap receiving member 40, the complementary member 41 and the adhesive for bonding may be the same as in the above-mentioned first embodiment.

Irrespective of the mounting layout of the driving elements 5, the upper surfaces of the driving elements 5 can be used as the cap receiving site enclosing the discharge ports 2 by changing the configuration and mounting layout of the complementary member or members 41.

The other components in this embodiment are the same as in the above-mentioned first embodiment. The same reference numerals are assigned to the corresponding components, and the detailed description is omitted here.

In this embodiment as well, as described above, the surface area of the element board can be reduced, eliminating the necessity of a special area for receiving the cap on the element board as in the conventional board.

Furthermore, the cap 17 is received by a filmy cap receiving member 40 attached to the upper surfaces of the driving elements 5 and of the complementary member 41 arranged on the element board 1, thus ensuring tight capping. There never occurs non-discharge upon starting discharge. Since the area of the element board can be reduced, it is possible to reduce the cost of the liquid ejecting head.

Fourth Embodiment

A fourth embodiment of the liquid ejecting head of the invention will now be described with reference to FIGS. 9 and 10.

Figure 9:
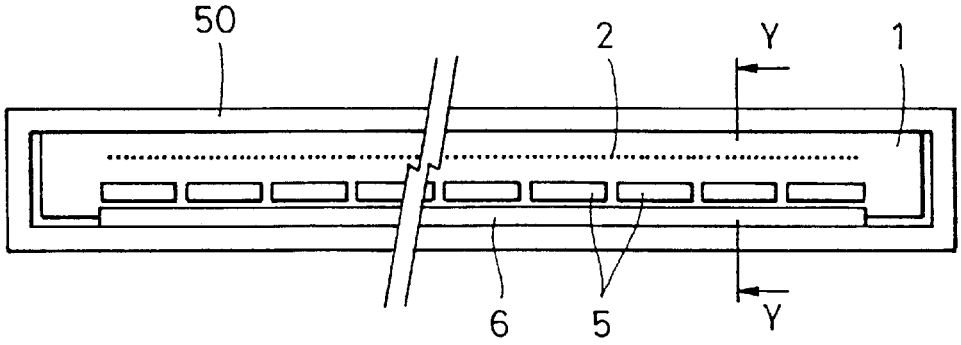
FIG. 9 is a plan view illustrating the liquid discharge surface of a fourth embodiment of the liquid ejecting head of the invention.

FIG. 9 is a plan view illustrating the liquid discharge surface in the fourth embodiment of the liquid ejecting head of the invention; FIG. 10A is a sectional view of the liquid ejecting head of the invention cut in a direction perpendicular to the discharge port arrangement direction (line Y—Y); and FIG. 10B is an enlarged sectional view of the liquid discharging section in the present embodiment.

In any of the aforementioned embodiments, it is not necessary to provide a special area for receiving the cap onto the element board, and it is possible to reduce the surface area of the element board and to accomplish secure, tight capping. Even if, however, the electrical connecting portions of the driving elements 5 and the flexible films 6 are covered with a sealing agent excellent in sealing and ion shielding abilities, the bent portions of the flexible films 6 are exposed to the sides of the liquid discharge surface of the element board 1. The reliability of the mounting portion is therefore insufficient because damage may be caused by deposition of liquid drops during use or by transfer jam of the recording medium.

In this embodiment, therefore, the bent portion of the flexible film is inside the cap receiving member and the cap receiving member serves also to protect the flexible film from the liquid, thus more certainly protecting the same from the liquid and improving reliability.

Figure 10B:
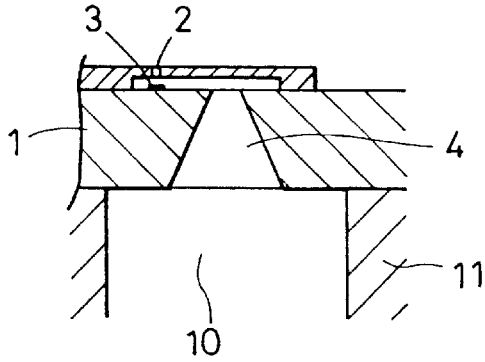
FIG. 10B is an enlarged sectional view of the discharge section in this embodiment.
Figure 10A:
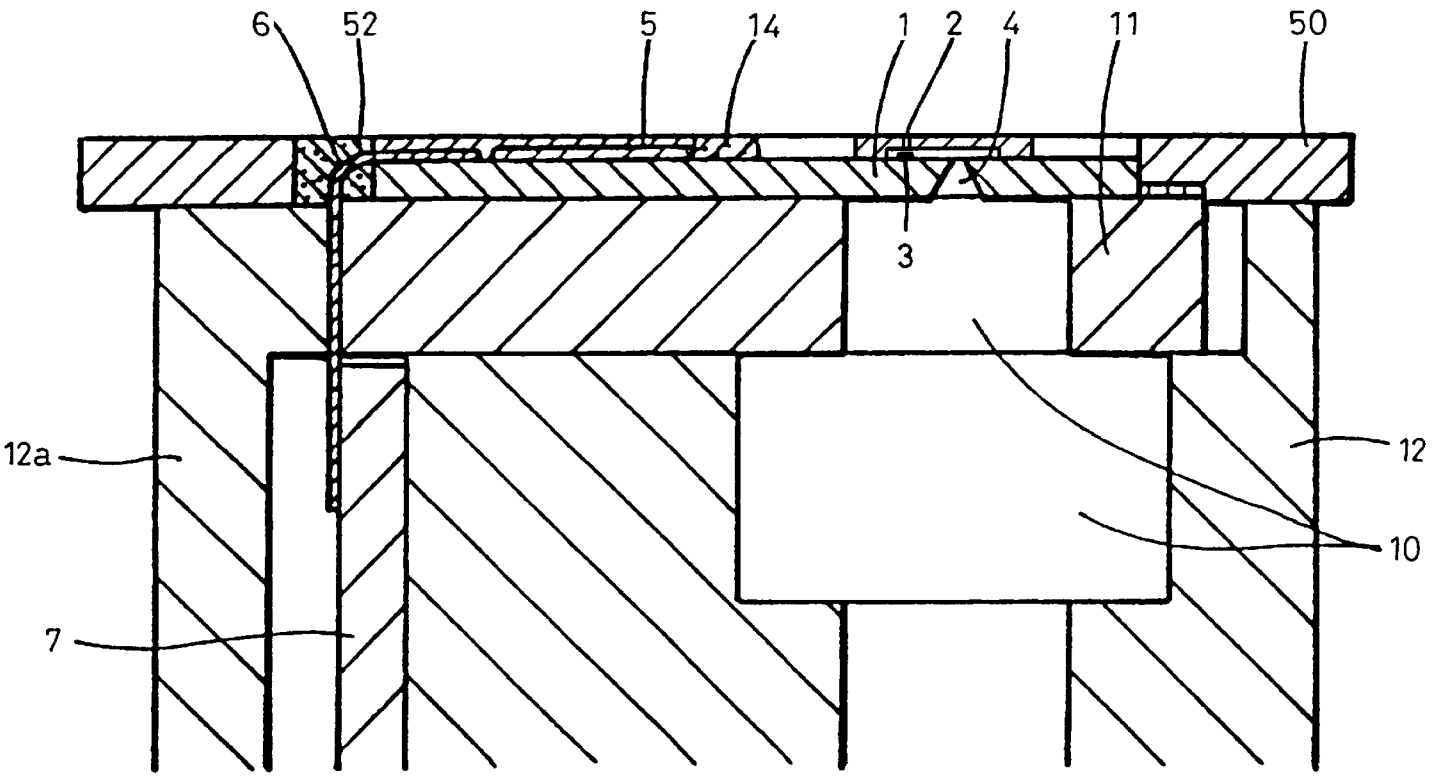
FIG. 10A is a sectional view of the fourth embodiment of the liquid ejecting head of the invention cut in a direction perpendicular to the discharge port arrangement direction (Y—Y line)

In the liquid ejecting head of this embodiment, as shown in FIGS. 9 and 10, a plurality of discharge ports for discharging the liquid are provided in a row on the surface side near the center of the element board 1. A plurality of heating elements 3 (see FIG. 10B) corresponding to the individual discharge ports 2 are formed on the element board 1. On the back of the element board 1, a common liquid chamber 10 for holding the liquid formed by a holding member 11 and a supporting member 12 having a length substantially equal to the length of the discharge port row is provided. A slit 4 for feeding the liquid from the back side to the surface side is also provided on the element board 1.

The driving element 5 having a transistor circuit for driving the heating element 3 and a logic circuit for driving this transistor circuit are mounted on the element board 1 by the COB connecting method via an anisotropic conductive film. An end of the flexible film 6 is connected via the anisotropic conductive film to an end of the element board 1 by the COB connecting method. A circuit board 7 having an electric connector for inputting electric signals from outside the head is similarly connected to the other end of the flexible film 6. Electrical connecting sections of the driving element 5 and the flexible film 6 connecting them to the element board 1 are covered and sealed with a sealing agent 14 comprising a resin such as epoxy, silicone or fluorine ones excellent in sealing and ion shielding abilities.

In this embodiment, the cap is received by the cap receiving member 50 having a smoothly formed surface for preventing evaporation of volatile constituents of the liquid. The cap receiving member 50 is arranged on the supporting member 12 so as to surround the element board 1. A gap capable of receiving the inserted flexible film 6 is provided between the inner peripheral surface of the cap receiving member 50 and an end of the element board 1. The flexible film 6 connected to the element board 1 is inserted into this gap. The flexible film 6 is bent, as shown in FIG. 10A, at substantially a right angle from the end of the element board 1, and bonded to a side of the holding member 11 of the element board. The circuit board 7 is fixed to the supporting member 12. In FIG. 10A, the member represented by a reference numeral 12*a* is fixed to the circuit board 7 and a side of the supporting member 12 to cover the flexible film 6 and the circuit board 7. The upper surface of member 12*a* has a function of supporting the cap receiving member 50. As a result, the bent portion of the flexible film 6 is positioned between the cap receiving member 50 and the element board 1, and the bent portion is protected by the cap receiving member 50. A sealing agent comprising a resin such as silicone resin is charged into the gap between the inside surface of the cap receiving member 50 and the element board 1, ensuring protection of the flexible film 6 and maintaining hermeticity upon capping.

In this embodiment having the configuration as described above, it is not necessary to provide a special area for receiving the cap on the element board 1, thus permitting reduction of the element board surface area and ensuring secure, tight capping. By bending the flexible film 6 at a point inside the cap receiving member 50, it is possible to protect the flexible film 6 from liquid by the cap receiving member 50, thus ensuring protection from liquid and improving reliability. Since the flexible film 6 is not exposed to the recording medium conveying section, the flexible film is free from damage caused by defective conveyance of the recording medium. It is thus possible to provide a liquid ejecting head having a high reliability.

Fifth Embodiment

A fifth embodiment of the liquid ejecting head of the invention will now be described with reference to FIGS. 11 to 13.

Figure 11:
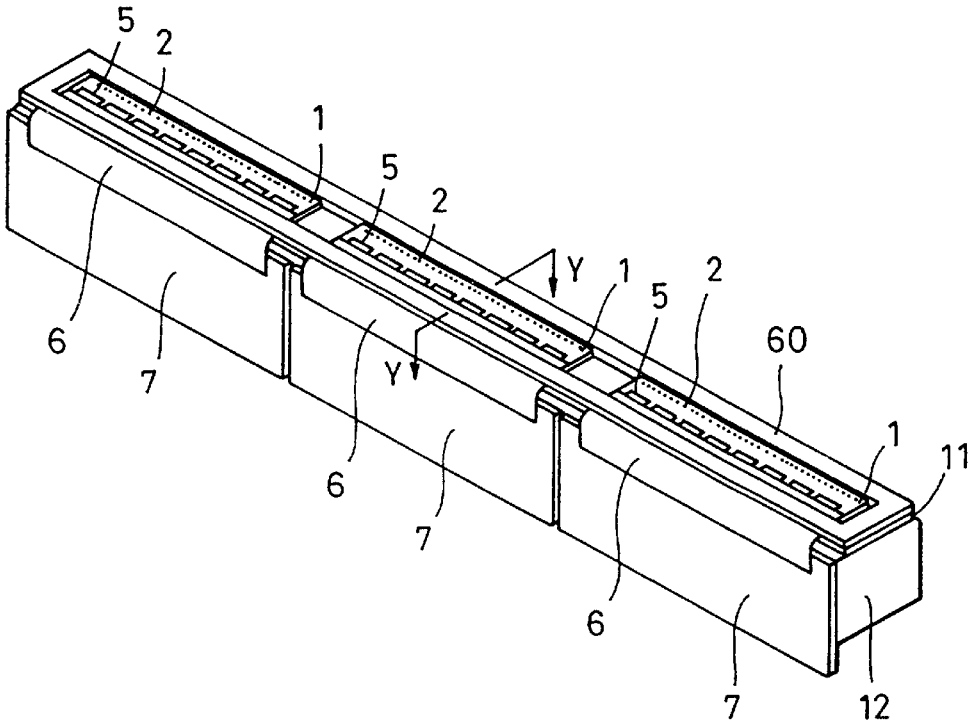
FIG. 11 is a perspective view illustrating a fifth embodiment of the liquid ejecting head of the invention.

FIG. 11 is a perspective view illustrating the fifth embodiment of the liquid ejecting head of the invention; FIG. 12 is a sectional view of the liquid ejecting head of this embodiment cut in a direction perpendicular to the discharge port arrangement direction (line Y—Y); and FIG. 13 is a perspective view illustrating a variant of the liquid ejecting head of this embodiment.

The above description of the embodiments has covered a liquid ejecting head using an element board 1 having a plurality of heating elements arranged in a row for imparting kinetic energy to the discharge ports 2 for discharging the liquid and to the liquid, having a common liquid chamber 10 for supplying the liquid to the heating elements 3 arranged on the back side of the element board 1, and capable of achieving a relatively long printing width. It is also possible, as shown in FIG. 11, to configure a full-line type long liquid ejecting apparatus having a plurality of element boards such as described above in the discharge port arrangement direction, the length of which apparatus occupies the entire width of the recording medium.

Figure 12:
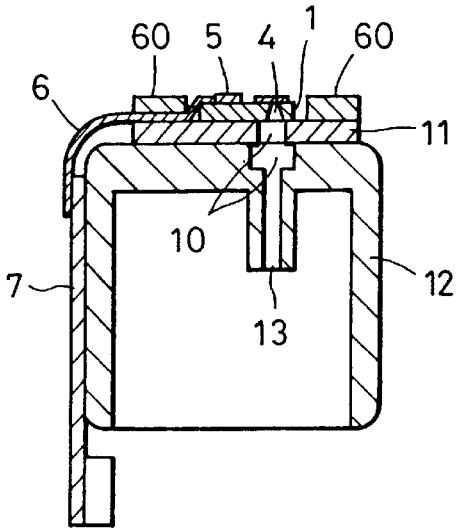
FIG. 12 is a sectional view of the fifth embodiment of the liquid ejecting head of the invention cut in a direction perpendicular to the discharge port arrangement direction (line Y—Y).
Figure 13:
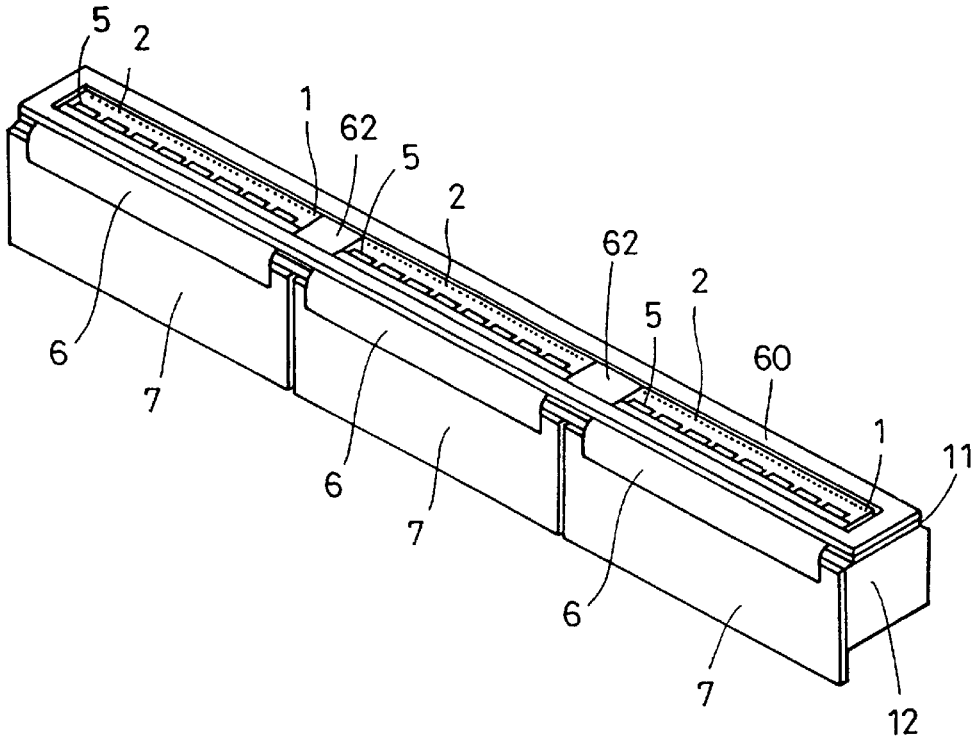
FIG. 13 is a perspective view illustrating a variant of the fifth embodiment of the liquid ejecting head of the invention.

In this embodiment, as shown in FIGS. 11 and 12, a cap receiving member 60 receiving a cap (not shown) for sealing the area of the discharge ports 2 is attached so as to surround the plurality of element boards 1 on the holding member 11 on which the plurality of element boards 1 are placed, for preventing evaporation of volatile constituents of the liquid during standby of the liquid ejecting head. At a portion where the flexible films 6 connected to the element boards 1 are positioned, the flexible films 6 are held between the holding member 11 and the cap receiving member 60.

In this configuration, the length, in terms of the recording width, of the individual element boards 1 is reduced, and it is not necessary to provide a special area for receiving the cap in the element boards 1. It is possible to reduce the surface area of the element boards, thus permitting improvement of yield of the element boards 1, resulting in reduction of the entire cost. The cap receiving member 60 can protect the flexible films 6 from liquid and from exposure to the recording medium conveyance section, and thereby eliminate damages to the flexible films 6 caused by defective conveyance of the recording medium.

However, in the liquid ejecting head shown in FIGS. 11 and 12, gaps or steps are produced in the connecting areas between the several element boards 1. When wiping off the liquid deposited onto the liquid ejecting head surface with a blade or the like, the liquid thus wiped off tends to accumulate in the gaps between the element boards 1 and to cause disturbance of the liquid discharging direction or non-discharge trouble. Also the blade passing over the step between element boards 1 may suffer from physical damage, thus causing a decrease in durability. To avoid these problems, therefore, a gap filler 62 having the same thickness as the element board 1 may be charged into the gaps or the steps. The liquid adhering to the liquid discharge surface can thus be wiped off completely, and accumulation of the liquid in the gaps between the element boards can be eliminated, thus permitting prevention of defective discharge of the liquid. It is also possible to reduce the steps within the moving area of the blade, thus permitting improvement of the wiping function and durability of the blade. It is needless to mention that, in a full-line type long liquid ejecting head in which a plurality of element boards are arranged in the discharge port arrangement direction as shown in FIGS. 11 to 13, in place of the configuration of the cap receiving member 60, the cap receiving configurations in the above-mentioned embodiments may appropriately be adopted.

Other Embodiments

A liquid ejecting apparatus using liquid ejecting heads having the configuration as described above will now be described with reference to FIG. 14.

Figure 14:
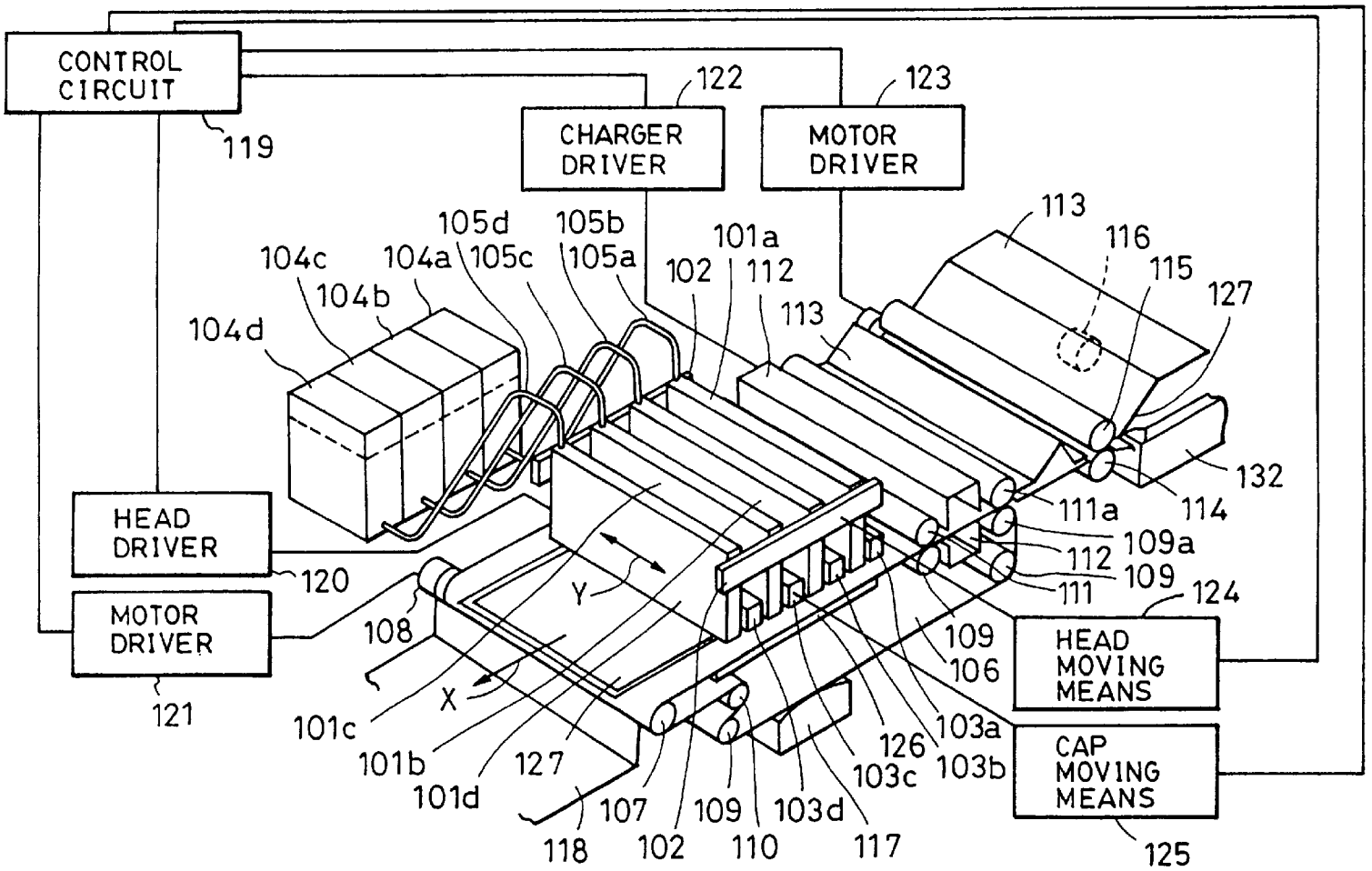
FIG. 14 is a schematic view illustrating a typical liquid ejecting apparatus using the liquid ejecting head of the invention.
Figure 15:
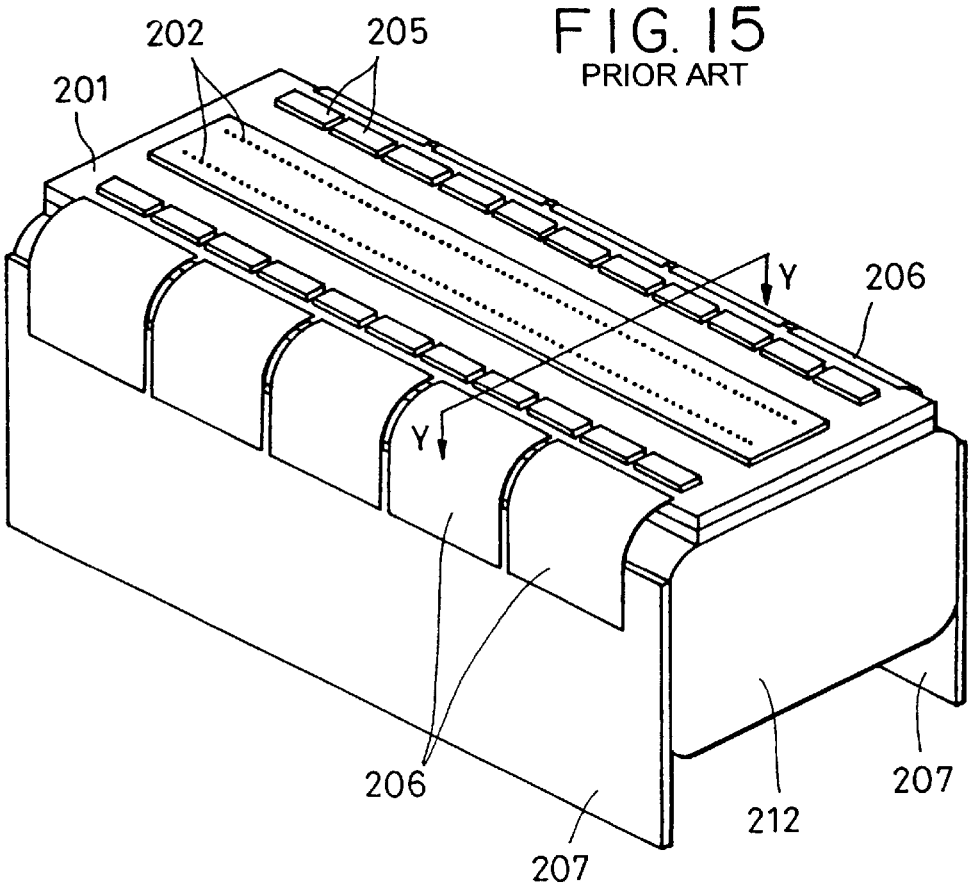
FIG. 15 PRIOR ART
FIG. 15 is a schematic perspective view of a liquid ejecting head in a conventional side shooter.
Figure 16:
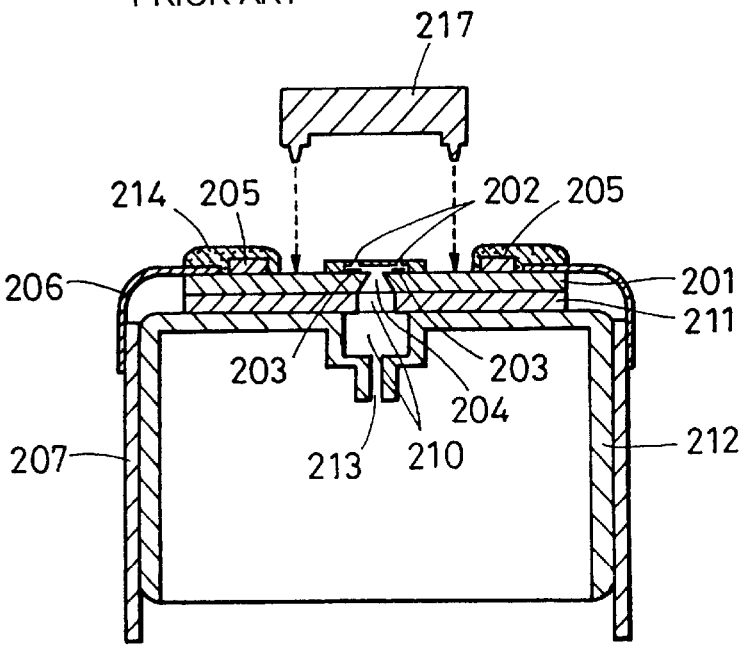
FIG. 16 PRIOR ART
FIG. 16 is a sectional view of the liquid ejecting head of the conventional side shooter cut in a direction perpendicular to the discharge port arrangement direction (line Y—Y).

In FIG. 14, heads 101*a* to 101*d* are full-line type liquid ejecting heads according to this embodiment (hereinafter referred to as a "head"), and are mutually and horizontally fixed and supported at prescribed intervals by a holder 102 in the arrow x direction. Discharge ports are provided downward throughout the entire recording width of recording paper 127, which is a recording medium, along the arrow Y direction on the lower surfaces of the heads 101*a* to 101*d*.

These heads 101*a* to 101*d* are of the type discharging the recording solution by use of heat energy, and discharge is controlled by a head driver 120.

A head unit is composed by the heads 101*a* to 101*d* and the holder 102, and this head unit is vertically movable by head moving means 124.

Caps 103*a* to 103*d* corresponding to the heads 101*a* to 101*d* arranged in the proximity of the lower parts thereof have respective ink absorbing sections such as sponges therein.

The caps 103*a* to 103*d* are fixed and supported by a holder not shown, and a cap unit is composed of the holder and the caps 103*a* to 103*d*. This cap unit is moved by cap moving means 125 in the arrow X direction so that the caps 103*a* to 103*d* conduct capping of the heads 101*a* to 101*d* when the heads 101*a* to 101*d* are in a standby state not discharging ink.

Color ink of cyan, magenta, yellow or black color is fed through ink feed tubes 105*a* to 105*d* from ink tanks 104*a* to 104*d* to the individual heads 101*a* to 101*d*, to permit color recording.

Ink feed is based on the capillary effect of the head discharge ports, and a liquid level of the ink tanks 104*a* to 104*d* is set at a level lower than the discharge port position by a certain distance.

A conveying apparatus for conveying the recording medium so as to face the head will be described.

A belt 106 for conveying recording paper 127, which is a recording medium, comprises a chargeable seamless belt.

The belt 106 is stretched around a driving roller 107, idle rollers 109 and 109*a* and a tension roller 110 along a prescribed path, and caused to run by a belt driving motor 108 driven by a motor driver 121.

The belt 106 runs in the arrow X direction immediately below the discharge ports of the heads 101*a* to 101*d*, where down shaking is inhibited by a fixing/supporting member 126.

A cleaning unit 117 for removing paper dust or the like adhering to the belt 106 surface is arranged under the belt 106 in the drawing.

A charger 112 for charging the belt 106 is turned on or off by a charger driver 122, and recording paper 127 is sucked to the belt 106 by an electrostatic suction force produced by charging.

Pinch rollers 111 and 111*a* for pressing the conveyed recording paper 127 against the belt 106 in cooperation with the idle rollers 109 and 109*a* are arranged before and after the charger 112.

The recording paper 127 in the paper feed cassette 113 is fed out sheet by sheet by the rotation of the paper feed roller 116, and conveyed to an angular guide 113 in the arrow X direction by the conveying roller 114 driven by a motor driver 123 and the pinch roller 115. The angular guide 113 has a mountain-shaped space for allowing flexure of the recording paper 127. Subsequently, recording is performed by the ink discharged from the individual heads 101*a* to 101*d* while the recording paper 127 is conveyed by the conveying roller 114, and the recording paper is finally discharged onto a paper discharge tray 118.

The head driver 120, the head moving means 124, the cap moving means 125, the motor drivers 121 and 223 and the charger driver 122 are all controlled by a control circuit 119.

In the above-described embodiments, liquid ejecting heads of the side shooter bubble jet type have been described. However, the present invention is applicable also to an edge shooter type liquid ejecting head and a piezo-type liquid ejecting head, with the same advantages as in the above-described embodiments.

While the present invention has been described with reference to what are presently consider to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid discharge head comprising:

a discharge port forming member having a plurality of discharge ports for discharging a liquid arranged therein;

an element board having a plurality of discharge energy generating elements for imparting discharge energy to the liquid provided to face said plurality of discharge ports, respectively;

a liquid feed port communicating with said plurality of discharge ports;

a holding member forming a common liquid chamber for feeding the liquid to said discharge ports via said liquid feed port of said element board and holding said element board;

a plurality of driving elements for driving said plurality of discharge energy generating elements; and a flexible circuit board for electrically connecting said plurality of driving elements to outside of said head, wherein said driving elements are mounted on said element board, and said flexible circuit board is connected to said element board and bent at substantially a right angle at a side of said element board; and wherein said liquid discharge head has a cap receiving member for receiving a cap for capping said liquid discharge head around said element board, and said cap receiving member is fixed to said holding member and has a shape enclosing said discharge port forming member.

2. A liquid discharge head according to claim 1, wherein said flexible circuit board is bent and inserted into a gap between said cap receiving member and said element board.

3. A liquid discharge head according to claim 2, wherein at least a portion of said flexible circuit board corresponding to a side of said holding member is covered with a protecting member fixed to a supporting member supporting said holding member, and at least a portion of said cap receiving member is arranged on said protecting member.

4. A liquid discharge head according to claim 2, wherein a sealing agent is charged into a gap between said cap receiving member and said element board.

5. A liquid discharge head according to claim 4, wherein a portion of said flexible circuit board arranged on said element board is covered with said sealing agent.

6. A liquid discharge head according to claim 1, wherein said discharge energy generating elements are heating elements which convert electric energy into heat energy, and discharge the liquid accompanied by a foaming phenomenon of the liquid.

* * * * *